United States Patent [19]

Bedell et al.

[11] Patent Number: 4,547,405

[45] Date of Patent: Oct. 15, 1985

[54] INK JET TRANSPARENCY

[75] Inventors: Stanley F. Bedell, Andover; Michael S. Viola, Burlington, both of Mass.

[73] Assignee: Polaroid Corporation, Cambridge, Mass.

[21] Appl. No.: 681,205

[22] Filed: Dec. 13, 1984

[51] Int. Cl.[4] ..... B41M 5/00

[52] U.S. Cl. ..... 427/256; 346/135.1; 427/261; 428/206; 428/323; 428/325; 428/331; 428/500

[58] Field of Search ..... 346/135.1; 427/261, 427/288, 214, 256; 428/206, 207, 211, 483, 325, 331, 500, 323

[56] References Cited

U.S. PATENT DOCUMENTS

| | | | |
|---|---|---|---|
| 4,308,542 | 12/1981 | Maekawa et al. | 346/135.1 |
| 4,446,174 | 5/1984 | Maekawa et al. | 346/135.1 |
| 4,460,637 | 7/1984 | Miyamoto et al. | 428/323 |

*Primary Examiner*—Bruce H. Hess

*Attorney, Agent, or Firm*—Philip G. Kiely

[57] ABSTRACT

An ink jet recording sheet comprising a transparent support carrying a layer comprising 5–100% by weight of a coalesced block copolymer latex of polyvinyl alcohol with polyvinyl (benzyl ammonium chloride) and 0–95% by weight of a water-soluble polymer selected from the group consisting of polyvinyl alcohol, polyvinyl pyrrolidone and copolymers thereof.

12 Claims, No Drawings

INK JET TRANSPARENCY

BACKGROUND OF THE INVENTION

Ink jet printing refers to a method of forming type characters on a paper by ejecting ink droplets from a printhead from one or more nozzles. Several schemes are utilized to control the deposition of the ink droplets on the printing substrate or recording sheet to form the desired characters. For example, one method comprises deflecting electrically-charged droplets by electrostatic means. Another method comprises the ejection of single droplets under the control of a piezoelectric device. One type of ink employed is the so-called non-drying type which functions by quickly penetrating the substrate, e.g., paper fibers, thus giving the appearance of being dry to the touch even though still possessing a quantity of relatively low vapor pressure solvent. Another widely used type of ink are aqueous inks, that is, inks which are composed of a relatively large quantity of water which functions as the solvent and carrier for the dyes therein. Aqueous inks, however, suffer from the deficiency of lack of stability to moisture, i.e., poor water-resistance on the printed substrate which causes loss of resolution in the image. This can occur even when the printed records are stored in areas of relatively high humidity.

The image generated by an ink jet printing device may be either in the form of a reflection print wherein the image is deposited on a substantially opaque reflective example, when the image is formed on a sheet such a paper or may comprise a transparency, that is, when the image is formed on a substantially transparent recording substrate and is viewed by illuminating the side of the substrate opposite the image side and viewing from the image side. Such material is, of course, particularly advantageous for use in viewing by projection.

Since projection of a transparency generally involves enlarging of the image, it will be seen that the image quality requirements are more stringent for a transparency than for an image viewed by reflection. Of course a transparency must take into consideration the other problems which may be common to both the transparency and to the reflection image, for example, the water fastness problem discussed above when aqueous inks are employed.

U.S. Pat. No. 4,269,981 issued May 26, 1981 is directed to a recording sheet for ink jet recording which can be viewed under both reflected and transmitted light and which comprises a support and an ink-absorbing layer provided on said support wherein said ink absorbing layer comprises a white pigment having ink-absorbing abilities and a binder resin possessing film-forming ability. As examples of suitable white pigments, mention is made of clay, talc, diatomacious earth, calcium carbonate, titanium dioxide and the like. As examples of suitable binder materials, mention is made of oxidized starch, etherified starch, gelatin, casein, hydroxyethyl cellulose, polyvinyl alcohol and the like.

See also Japanese Pat. No. 5614583 and German Pat No. 3,024,205 for other disclosures of polyvinyl alcohol as a binder for pigments, such as calcium carbonate or micropowders such as silicic acid.

Generally, when used alone, a layer of polyvinyl alcohol is not suitable as a receptor layer for ink jet recording systems employing aqueous based inks. Such layers are often too tacky after receiving the ink.

SUMMARY OF THE INVENTION

The present invention is directed to a printing substrate adapted to produce transparencies, which comprises an ink jet recording sheet comprising a transparent support carrying a layer comprising 5–100% by weight of a coalesced block copolymer latex of polyvinyl alcohol and polyvinyl (benzyl ammonium chloride) and 0–95% by weight of a water-soluble polymer selected from the group consisting of polyvinyl alcohol, polyvinyl pyrrolidone and compolymers thereof.

DETAILED DESCRIPTION OF THE INVENTION

The present invention is directed to a printing substrate for use with inks which are predominantly water-based. The terms "water-based inks" and "aqueous inks" as used herein are intended to refer to ink compositions wherein the solvent or carrier liquid is at least about 50% water by weight. In addition to water and dyes or pigments, such inks also typically contain humectants, organic solvents, detergents, thickeners, preservatives and the like.

It has now been found that by employing as a receptor layer for use in an ink jet printing process a layer comprising a coalesced block copolymer latex of polyvinyl alcohol and polyvinyl (benzyl ammonium chloride), alone or with up to 95% by weight of a specified water-soluble polymer, significantly improved performance in terms of increased density, water and light fastness and dot spreading are obtained. Unexpectedly, significantly enhanced results are found using a combination of as little as 5% of the block copolymer with polyvinyl alcohol compared to 100% polyvinyl alcohol.

U.S. Pat. No. 4,080,346, issued Mar. 21, 1978 to Stanley F. Bedell, incorporated by reference herein, is directed to novel graft copolymers having vinylbenzyl ammonium halide residue which are particularly useful as photographic diffusion transfer image dye mordants. At col. 8, line 61 to col. 9, line 36 is detailed the preparation of the graft copolymers, particularly using a ceric ion catalyst. However, it has been found that when vinyl benzyl halides are polymerized with polyvinyl alcohol in the presence of a ceric ion catalyst, e.g., ceric ammonium nitrate, wherein the weight ratio of catalyst to polyvinyl alcohol is less than 1:5, preferential initiation takes place at the 1,2 glycol units and a block copolymer is formed, not a graft copolymer. Further, if the tertiary amine reacted with the thus-formed block copolymer is triethyl amine, tributyl amine, N-methyl imidazole, N-methyl morpholine or $\alpha$-picoline, a latex is prepared. The term "ammonium" as used herein to describe the block copolymer is intended to refer to those tertiary amines which will form latices when reacted with the block copolymer formed with polyvinyl alcohol and vinyl benzyl halides. The latex nature of the reaction product could not be predicted from the hydrophilic nature of the amine.

As stated above, the block copolymer coalesced latex can be employed alone or blended with up to 95% by weight of a water-soluble polymer, e.g., polyvinyl alcohol, gelatin and polyethylene oxide.

In a preferred embodiment, the polyvinyl alcohol with which the block copolymer is blended is partially hydrolyzed. If fully hydrolyzed polylvinyl alcohol is employed in the blend best results are obtained if the ink is in excess of 50% water. Increasing concentration of fully hydrolyzed polyvinyl alcohol requires inks with increasing amounts of water.

In an alternative embodiment, the polyvinyl alcohol layer may include up to about 0.3% by weight, based on the weight of the polyvinyl alcohol of particulate material less than about 25 micrometers in size. Such materials enhance the antiblocking characteristics of the recording sheet particularly after it has been printed on without adversely effecting the transparent characteristics of the sheet. As examples of suitable particulate materials, mention may be made of silica, glass beads and polytetrafluoroethylene particles.

The novel transparency materials of the present invention were prepared by coating the polymer of a 4 mil transparent polyester base, drying and then evaluating using a Canon Model A-1210 Ink Jet Printer with a water-based ink containing glycerine and at least 50% water. Evaluation of the print included degree of dot spreading and time of drying. The following Table sets forth formulations which possessed sufficient dot spreading characteristics to form a character without gaps and was dry to the touch, i.e., did not smear, in about 10 seconds. Coverage of the polymer was about 1000 mg/ft$^2$.

TABLE

| | % by weight |
|---|---|
| 1. Block copolymer of polyvinyl alcohol and polyvinyl (benzyl N—methyl imidazolium chloride) | 50 |
| Polyvinyl alcohol (GELVATOL 20-90, 87% hydrolysis, sold by Monsanto Company, St. Louis, MO) | 50 |
| 2. Block copolymer of polyvinyl alcohol and polyvinyl (benzyl N—methyl imidazolium chloride) | 75 |
| Polyvinyl alcohol (GELVATOL 20-90, 87% hydrolysis, sold by Monsanto Company, St. Louis, MO) | 25 |
| 3. Block copolymer of polyvinyl alcohol and polyvinyl (benzyl N—methyl imidazolium chloride) | 25 |
| Polyvinyl alcohol (GELVATOL 20-90, 87% hydrolysis, sold by Monsanto Company, St. Louis, MO) | 75 |
| 4. Block copolymer of polyvinyl alcohol and polyvinyl (benzyl N—methyl imidazolium chloride) | 25 |
| Polyvinyl alcohol (GELVATOL 20-90, 87% hydrolysis, sold by Monsanto Company, St. Louis, MO) | 74 |
| Hydroquinone | 1 |
| 5. Block copolymer of polyvinyl alcohol and polyvinyl (benzyl N—methyl imidazolium chloride) | 25 |
| Polyvinyl alcohol (GELVATOL 20-90, 87% hydrolysis, sold by Monsanto Company, St. Louis, MO) | 70 |
| Hydroquinone | 5 |
| 6. Block copolymer of polyvinyl alcohol and polyvinyl (benzyl N—methyl imidazolium chloride) | 5 |
| Polyvinyl alcohol (GELVATOL 20-90, 87% hydrolysis, sold by Monsanto Company, St. Louis, MO) | 95 |
| 7. Block copolymer of polyvinyl alcohol and polyvinyl (benzyl α-picolinium chloride) | 25 |
| Polyvinyl alcohol (GELVATOL 20-90, 87% hydrolysis, sold by Monsanto Company, St. Louis, MO) | 75 |
| 8. Block copolymer of polvinyl alcohol and polyvinyl (benzyl α-picolinium chloride) | 5 |
| Polyvinyl alcohol (GELVATOL 20-90, 87% hydrolysis, sold by Monstanto Company, St. Louis, MO) | 95 |
| 9. Block copolymer of polyvinyl alcohol and polyvinyl (benzyl N—methyl morpholinium chloride) | 25 |
| Polyvinyl alcohol (GELVATOL 20-90, 872 hydrolysis, sold by Monstanto Company, St. Louis, MO) | 75 |
| 10. Block copolymer of polyvinyl alcohol and polyvinyl (benzyl N—methyl morpholinium chloride) | 25 |
| Polyvinyl alcohol (GELVATOL 20-90, 87% hydrolysis, sold by Monsanto Company, St. Louis, MO) | 75 |
| 11. Block copolymer of polyvinyl alcohol and polyvinyl benzyl N—methyl imidazolium chloride) | 25 |
| Polyvinyl alcohol (GELVATOL 20-90, 87% hydrolysis, sold by Monsanto Company, St. Louis, MO) | 25 |
| Polyvinylpyrrolidone/vinyl acetate copolymer (60:40) | 50 |
| 12. Block copolymer of polyvinyl alcohol and polyvinyl (benzyl N—methyl imidazolium chloride) | 50 |
| Polyvinyl pyrrolidone (PVP K-90, sold by GAF, Corp., New York, NY) | 50 |
| 13. Block copolymer of polyvinyl alcohol and polyvinyl (benzyl N—methyl imidazolium chloride) | 37.5 |
| Polyvinyl alcohol (GELVATOL 20-90, 87% hydrolysis, sold by Monsanto Company, St. Louis, MO) | 37.5 |
| Polyvinylpyrrolidone/vinyl acetate copolymer (60:40) | 25 |
| 14. Block copolymer of polyvinyl alcohol and polyvinyl (benzyl N—methyl imidazolium chloride) | 45 |
| Polyvinyl alcohol (GELVATOL 20-90, 87% hydrolysis, sold by Monsanto Company, St. Louis, MO) | 45 |
| Polyvinylpyrrolidone/vinyl acetate copolymer (60:40) | 10 |
| 15. Block copolymer of polyvinyl alcohol and polyvinyl (benzyl N—methyl imidazolium chloride) | 25 |
| Polyvinyl alcohol (VINOL 540, 87% hydrolysis, sold by Air Products and Chemicals, Inc. Allentown, PA) | 75 |
| 16. Block copolymer of polyvinyl alcohol and polyvinyl (benzyl N—methyl imidazolium chloride) | 50 |
| Polyvinyl alcohol (VINOL 540, 87% hydrolysis, sold by Air Products and Chemicals, Inc. Allentown, PA) | 50 |
| 17. Block copolymer of polyvinyl alcohol and polyvinyl (benzyl N—methyl imidazolium chloride) | 100 |

It should also be understood that the layer carried on the transparent support can also include such addenda as ultraviolet absorbers, antioxidants, surfactants, humectants, bateriostats and cross-linking agents.

The support employed in the present invention is not critical. Polymeric films of both synthetic and those derived from naturally occurring materials may be employed. As examples of suitable transparent polymeric materials, mention may be made of polymethacrylic acid; methyl and ethyl esters; polyamides, such as nylons; polyesters, such as the polymeric films derived from ethylene glycol terephthalate acid; polymeric cellulose derivitives; polycarbonates; polystyrene and the like. To promote adhesion, subcoats or surface treatments such as corona discharge may be employed.

What is claimed is:

1. An ink jet recording sheet comprising a transparent support carrying a layer comprising 5-100% of a coalesced block copolymer latex of polyvinyl alcohol and polyvinyl (benzyl ammonium chloride) and 0–95% by weight of a water-soluble polymer selected from the group consisting of polyvinyl alcohol, and polyvinylpyrrolidone and copolymers thereof.

2. The product of claim 1 wherein said layer comprises 75% of said block copolymer and 25% of polyvinyl alcohol.

3. The product of claim 1 wherein said polyvinyl (benzyl ammonium chloride) is polyvinyl (benzyl triethyl ammonium chloride).

4. The product of claim 1 wherein said polyvinyl (benzyl ammonium chloride) is polyvinyl (benzyl N-methyl imidazolium chloride).

5. The product of claim 1 wherein said polyvinyl (benzyl ammonium chloride) is polyvinyl (benzyl-α-picolinium chloride).

6. The product of claim 1 wherein said polyvinyl (benzyl ammonium chloride) is polyvinyl (benzyl N-methyl morpholinium chloride).

7. The product of claim 1 wherein said polyvinyl (benzyl ammonium chloride) is polyvinyl (benzyl tributyl ammonium chloride).

8. The product of claim 1 wherein said layer includes up to 0.3% by weight of particulate material less than 25 micrometers in size.

9. The product of claim 8 wherein said particulate material is silica.

10. The product of claim 8 wherein said particulate material is glass beads.

11. The product of claim 1 wherein said support is polyethylene terephthalate.

12. The method of ink jet printing which comprises contacting a recording sheet with at least one stream of droplets generated from an ink jet printer, wherein said recording sheet comprises a transparent support carrying a layer comprising 5–100% of a coalesced block copolymer latex of polyvinyl alcohol and polyvinyl (benzyl ammonium chloride) and 0–95% of a water-soluble polymer selected from the group consisting of polyvinyl alcohol and polyvinyl pyrrolidone and copolymers thereof.

* * * * *